United States Patent [19]

Rickard

[11] Patent Number: 4,476,845

[45] Date of Patent: Oct. 16, 1984

[54] ARCHERY BOWSTRING RELEASING DEVICE

[76] Inventor: Lawrence C. Rickard, 116 W. Pine Tree Ave., Lake Worth, Fla. 33463

[21] Appl. No.: 428,834

[22] Filed: Sep. 30, 1982

[51] Int. Cl.[3] ..... F41B 5/00

[52] U.S. Cl. ..... 124/35 A

[58] Field of Search ..... 124/35 A, 23 R, 24 R, 124/41 A, 35 R

[56] References Cited

U.S. PATENT DOCUMENTS 4,134,369 1/1979 Cook ..... 124/35 A 4,151,825 5/1979 Cook ..... 124/35 A

*Primary Examiner*—Richard J. Apley

*Assistant Examiner*—William A. Browne

*Attorney, Agent, or Firm*—Malin, Haley & McHale

[57] ABSTRACT

A tensional line release device with an adjustable, 360 degrees rotatable pull handle permitting smooth, steady release by a single finger trigger squeeze of a tensional line such as an archer bowstring allowing the maintenance of a stabilized aim. The device is composed of a tensional string retention chamber containing two contiguous, line impinging spheres, mounted in an inner journal, which are held together in an impinging position by inward pressure applied on the diametrically opposite points of the spheres by an external journal of the mechanism. Activation of the trigger mechanism results in movement of the external yoke decreasing the inward pressure on the two spheres so that impinging pressure contact between the two contiguous spheres is instantaneously overcome by the tension on the line causing it to slip between the spheres in a smooth release in a forward direction with no imposed horizontal oscillation or vertical bind.

6 Claims, 14 Drawing Figures

ARCHERY BOWSTRING RELEASING DEVICE

BACKGROUND OF THE INVENTION

This device relates to the field of release mechanisms and more particularly to trigger-activated, quick release, frictional mechanisms for smooth and quick release of lines under tension such as bowstrings. In the utilization of bows in archery and hunting, a bowstring pulling and release device is of utility in maintaining an even, steady pressure on the bowstring to enhance accuracy in shooting by assuring smooth release of the bowstring. The retention of the tensional line by the impinging spheres and the instantaneous release occasioned by the distinct separation of spheres upon the decrease of inward pressure from the external yoke provides for steady pulling, aiming and releasing of a bowstring with a resultant increase in accuracy over other traditional and conventional methods.

The instant invention is designed to incorporate the convenience, versatility and stability of a smooth single finger controlled release free of imposed horizontal oscillation or vertical bind which would interfere with a true release.

The present invention relates generally to a device whose primary features of bowstring retaining and releasing allow reduced release friction and oscillation upon string release. Squeezing of the trigger in turn moves the external yoke, releasing the inwardly directed contact pressure between the retaining spheres and allowing the bowstring to be released in a forward direction between and tangentially to the sphere surfaces.

BRIEF SUMMARY OF THE INVENTION

The device is comprised generally of a rod shaped body having a handle at one end (perpendicularly attached) and a pair of coaxial bifurcated fingers at the opposite end. The bifurcated fingers include juxtaposed apertures that receive and house a pair of moveably engageable spheres. The spheres are retained in the bifurcated internal journal in generally impinging contact by a external yoke having inner walls that engage the outer diametral points on the spheres. A finger actuated trigger is connected to the external yoke that effects movement of the walls which release the inward force on the spheres. A spring resiliently locks the external yoke and spheres in the rigid contact position.

All embodiments presented in the instant invention provide for simple insertion of this bowstring by releasing the tension on the impinging spheres by moving the trigger to the rear, thereby removing or lessening the contact of the impinging yoke. The instant invention is then placed on the bowstring by sliding it past the now loosely situated spheres. Re-engaging the triggering mechanism will place the spheres in forceful impinging contact thereby retaining the bowstring to the rear of said spheres ready to exert tension on the bowstring by being pulled to the rear.

All embodiments of the instant invention provide smooth release in a forward direction with no imposed horizontal oscillation or vertical bind.

It is an object of this invention to provide a manually held bowstring retaining and releasing device wherein the bowstring is released upon trigger pressure by slipping past two freely impinging low friction spheres allowing straight forward release of the bowstring with neither imposed horizontal oscillation nor vertical bind.

Another object of this invention is to provide such a bowstring releasing device which may be operated equally by either a right or left handed archer.

Still another object of this invention is to provide such a bowstring releasing device whose parts may be positioned within a full 360 degree circle to accommodate the wrist and arm twist of each individual archer.

Yet another object of this invention is to provide such a bowstring releasing device which may be carried in the hand so as to allow the thumb and index finger freedom to load the bow.

A further object of this invention is to provide such a bowstring releasing device which may be used in conjunction with other archery accessories such as wristband or gloves.

Another object of this invention is to present a device which permits the quick smooth release of any line held under tension by the device.

Yet another object is to present such a device which would permit the quick smooth release of a water ski rope.

Still another object of this invention is to present such a device having a trigger mechanism which is adjustable to allow "hair trigger" release of the line held.

In accordance with these and other objects which will become apparent hereinafter, the instant invention will now be described with reference to the accompanying drawings.

PREFERRED EMBODIMENT OF THE INVENTION

Figure 1:
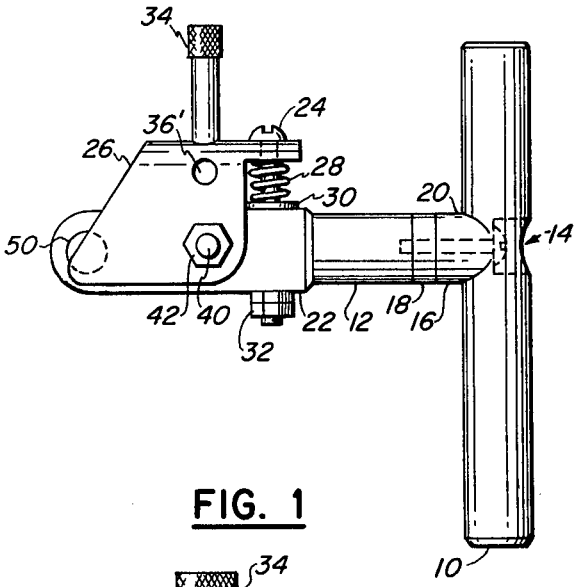
FIG. 1 is a side elevational view of the fully assembled operational device as used with the bowstring in the fully vertical position.
Figure 12:
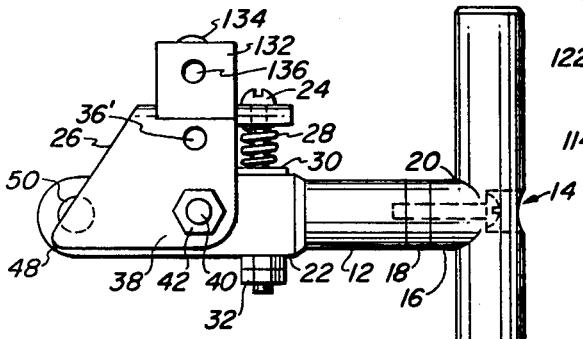
FIG. 12 is a side view of the embodiment in FIG. 1 with a trigger housing.
Figure 12A:
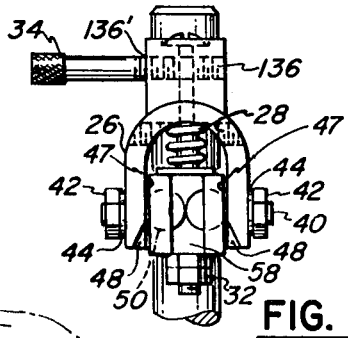
FIG. 12A is a frontal view of the embodiment in FIGS. 1 and 2 with a trigger housing.

Referring now to the drawings and more specifically to FIG. 1, the instant invention is shown as comprised of a rod shaped handle 10, joined perpendicularly to shaft 12 by means of a bolt 14 which extends through spacers 16 and 18 into and along the shaft axis. The handle 10 is fully rotatable 360 degrees about the shaft 12 upon release and retightening of the bolt 14. The main body 22 at its attachment point 20 to the handle 10 is cylindrical in shape but at a distance of approximately one inch therefrom assumes a square cross-section, and is almost immediately thereafter intersected generally perpendicularly by bolt 24 which passes through aperture 25 in the external bifurcated yoke 26, a spring 28, a washer 30, aperture 27 in the body 22, the device 12, and two hexagonal nuts 32. This attachment allows the external yoke 26 to pivot about bolt 40 which is secured by nut 42 at an angle with respect to the main body 22 by application of pressure in a direction generally at right angles to the external yoke 26 and rearward toward the handle 10, the pressure being applied upon the trigger 34 which is threaded into a position generally perpendicular to the external yoke at aperture 36, 36' or 36", an aperture on the side of yoke 26, see FIGS. 1, 2, 5 and 6. Its front main body 22 is bifurcated to form a two-prong fork having two generally parallel armatures 23 defining a slot 58 (see FIG. 3). As shown in FIGS. 12 and 12A, an alternative embodiment of the trigger 34 provides for a generally box-shaped trigger housing 132 which is attached to the top of external yoke 26 by a bolt 134 threaded into an appropriate aperture 36 in external yoke 26 at a generally perpendicular position. Trigger 34 may then be threaded into an appropriate aperture in trigger housing 132 at position 136 or position 136' which is on the opposite side of trigger housing 132 from position 136. Threaded into either position 136 or 136' trigger 34 presents a protrusion which is generally perpendicular to trigger housing 132 and external yoke 26 and generally parallel to bolt 40. In each embodiment shown in FIGS. 1 and 12, pressure on the trigger 34 rearward toward the handle 10 results in rotational motion of the external yoke 26 about open-ended bolt 40. In FIGS. 1, 2, 12 and 12A, bolt 40 is affixed at each end by a washer 44 and hexagonal nut 42 and extending through one arch of the external yoke 26, the main body 22 and then the other arch of the external yoke 26. The pressure that must be applied to trigger 34 in order to cause the external yoke 26 to pivot sufficiently to allow release of the bowstring may be adjusted by tightening or loosening the nuts 42.

Figure 3:
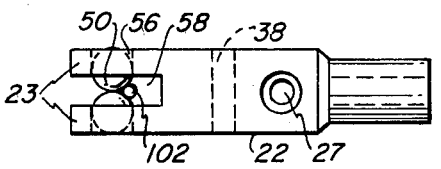
FIG. 3 is a top plan view of the housing.
Figure 4:
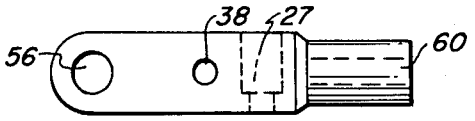
FIG. 4 is a side elevational view of the housing.
Figure 2:
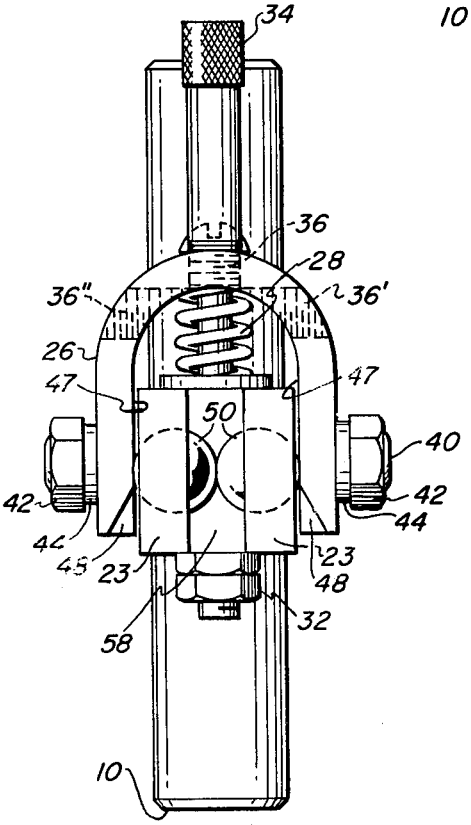
FIG. 2 is a front elevational view of the instant invention.

FIGS. 2, 3, and 4 show the spatial relationships along the main body 22 and armatures 23 wherein are situated the sphere retaining apertures 56 wherein reside spheres 50. Bowstring 102 is retained in slot 58 by the spheres 50 which are pressed together by impinging contact with the internal walls 47 of the external yoke 26. The two spheres 50 reside partially in the two sphere retaining aperture 56 and partly protrude into slot 58. Inward pressure exerted on spheres 50 by external yoke 26 causes the spheres 50 to impinge and bisect slot 58. Bowstring 102 occupies slot 58 to the rear of spheres 50 impinging against the spheres 50 which restrain forward displacement of bowstring 102 through and between spheres 50. In an alternate embodiment, the lower edges of external yoke 26 in juxtaposition with spheres 50 may be inclined from the inside to the outside as shown in FIG. 2 (in phantom). Inclined sections 48 of the external yoke 26 provides for an accelerated outward displacement of the inner surface of the internal walls 47. As external yoke 26 is rotated upward the spheres 50 impinge upon the inner surface of internal walls 47 until the leading edge of inclined section 48 impinges upon spheres 50. At this time the increasing outward inclination of the internal walls 47 gradually, although instantaneously, reduces the impinging force between the spheres 50 and allows them to separate under this tensional pressure of bowstring 102 until bowstring 102 is propelled through and between the spheres 50. The inclination of inclined sections 48 are identical to provide for equal and even distribution of the impinging force. The sudden displacement of spheres 50 by inclined sections 48 provides for a quick, even release of the bowstring, thereby preventing horizontal oscillation or vertical bind. In the embodiment disclosed in FIG. 2, the internal walls 47 of external yoke 26 are flat (not inclined) and generally parallel. In this embodiment, the rotation of yoke 26 by trigger 34 results in internal walls 47 maintaining constant, continual impinging contact with spheres 50 until the lower edges of yoke 26 pass the outermost protruding portion of the surface of spheres 50. At this time, the inward impinging force on the spheres 50 and internal walls 47 diminishes rapidly due to the curved nature of the surface of spheres 50. This abrupt reduction in impinging force is instantaneous and equal and provides for an even reduction in impinging force between the spheres 50 and allows them to separate under the tensional pressure of bowstring 102 until bowstring 102 is propelled through and between spheres 50. This abrupt reduction also provides for a quick, even release of the bowstring, thereby preventing horizontal oscillation or vertical bind. The use of impinging spheres 50 provide for even distribution of the tension on the restraining surface of the spheres and the curved surface of the slot created by the spheres enhances control of horizontal oscillation and vertical bind. Spheres 50 are held loosely in the retaining apertures 56 so that the spheres 50 may rotate freely to facilitate passage of the bowstring 102 between spheres 50. The rapid displacement of spheres 50 by the above two embodiments provides for swift release thereby producing a "surprise" release thereby eliminating flinching by the archer caused by anticipation of the release. FIG. 4 in particular also shows the tapped cavity 60 wherein bolt 14 (FIG. 1) fits attaching the handle 10 to the main body 22 as well as the aperture 27 through which bolt 24 fits (FIG. 1). This aperture 27 is lined up with the corresponding aperture 25 (FIG. 5) in the external bifurcated yoke 26 in the assembled device. Hole 38 allows insertion of open-end bolt 40 for pivotal connection between external bifurcated yoke 26 (FIG. 1) and main body 22 (FIG. 1).

Figure 5:
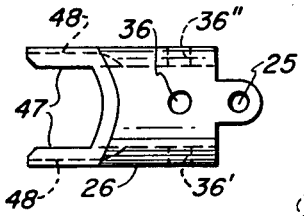
FIG. 5 is a top plan view of the sphere housing of the invention.
Figure 6:
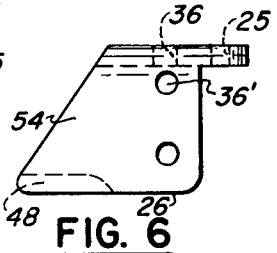
FIG. 6 is a side elevational view of the sphere housing.

In FIGS. 5 and 6, the alternative positions at apertures 36' and 36" for attachment of the trigger 34 are shown as on opposing sides of the external yoke 26. Trigger 34 may be threaded into an appropriately threaded aperture, in a generally parallel position to bolt 40. By placing trigger housing 132 (FIGS. 12 and 12A) on the external yoke 25, the moment arm between bolt 40 and trigger 34 is increased reducing the force necessary to displace trigger 34 toward the rear thereby activating the release mechanism.

Figure 7:
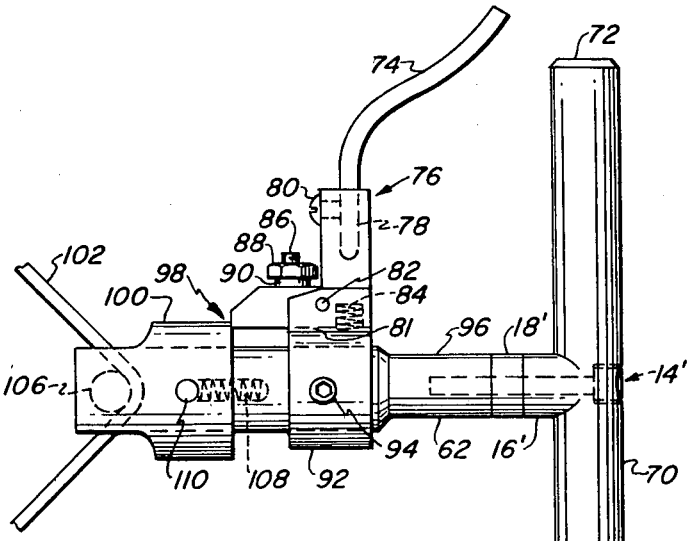
FIG. 7 is a side elevational view of an alternate embodiment of the instant invention.
Figure 8:
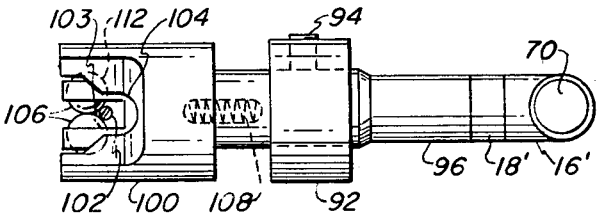
FIG. 8 is a bottom plan view of the alternate embodiment.
Figure 9:
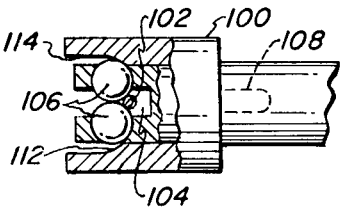
FIG. 9 is a top plan cutaway view of the sphere bearing chamber wherein a segment of bowstring is contained.

An alternate embodiment of the instant invention is shown in FIGS. 7 through 9. In FIG. 7 in particular, it can be seen that main body 96 has perpendicularly attached the handle 70 containing at one end a tapped cavity 72 wherein may be added a riser for cheek rest or anchor point. The attachment to the main body 96 is identical to that used in the first embodiment shown in FIG. 1 with bolt 14' through spacers 16' and 18' and into tapped hole 62. The trigger 74 is comprised of thin curved metal and is capable of delicate control upon being displaced toward the handle 72. This fine trigger 74 extends to attach to the main trigger housing 76 by insertion into cavity 78 wherein it is tightly fitted at any desired angle by screw 80. The main trigger housing 76 is generally L-shaped, and is pivotally attached by pin 82 to a pair of parallel brackets 81 which protrude from posterior rotating base 92. Spring 84 is positioned between brackets 81 at the heel of the L-shaped main trigger housing 76 compressed between trigger housing 76 and posterior base 92. Spring 84 biases trigger housing 76 to a forward position impinging against forward edge 98 of the main trigger housing 76 upon release of trigger 74. Bolt 86 and nut 88 and washer 90 are inserted through the forward lower section of the trigger (foot of the L) with the nut on top to regulate the insertion of bolt 86 which limits trigger travel downward to regulate the impinging contact at forward edge 98 between trigger housing 76 and anterior sliding yoke 100. The posterior rotating base 92 is held with set screws 94 to the main body 96.

In the impinging position, the forward edge 98 of the main trigger housing 76 prevents the anterior sliding yoke 100 from traveling toward the posterior base 92 by simple physical blockage. Activation of the trigger housing 76 by movement of trigger 74 releases this blockage and forward tension of the bowstring 102 against slot 103 formed by the converging surfaces of spheres 106 inside the chamber 104 allows bowstring 102 to force spheres 106 to impinge against the slanting anterior walls 112 of anterior yoke 100. The impinging force of spheres 106 against anterior walls 102 compels the anterior yoke 100 to slide rearward coaxially along the cylindrical forward portion of main body 96. Movement of the anterior sliding yoke 100 rearward depresses spring 108 which, along with pin 110, biases the sliding yoke in a forward position. At the same time the spheres 106 are released from the external pressure upon them by the slanting interior walls 112 and the flat walls 114 move into position by them are allowed to separate, releasing the bowstring 102 between them. The amount of pull necessary to pull the trigger is also adjustable in this embodiment of the invention. By tightening the nut 88 the amount of the face of edge 98 which is in contact with the yoke 100 is decreased. Thus, when the overlap between 98 and 100 is decreased to a very small amount of a "hair trigger" mechanism result.

FIG. 9 shows a cutaway view of the sliding yoke mechanism including the spring set cavity 114 containing the spring 108 (shown in FIG. 8) which returns the sliding yoke 100 to a full forward position when the outward pressure of the spheres is released upon passage of bowstring 102. The elongated hole 114 acts as a positive stop for the rearward travel of the sliding yoke 100.

Figure 10:
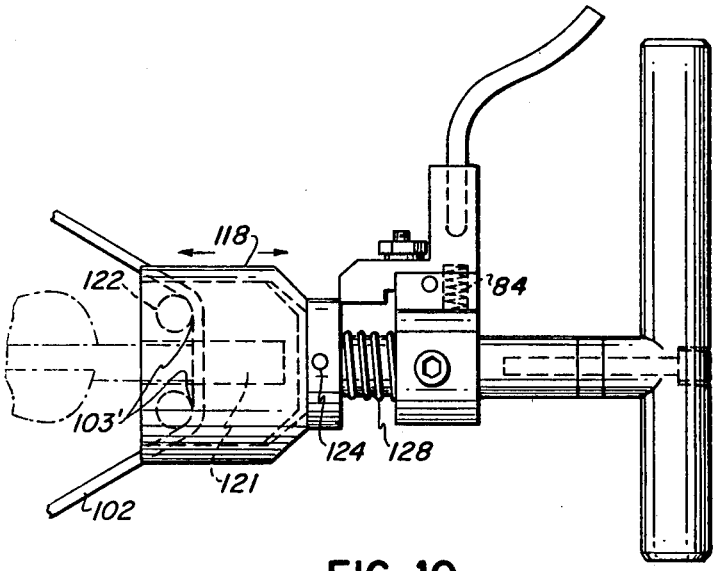
FIG. 10 is a side view of another alternate embodiment of the instant invention.
Figure 11:
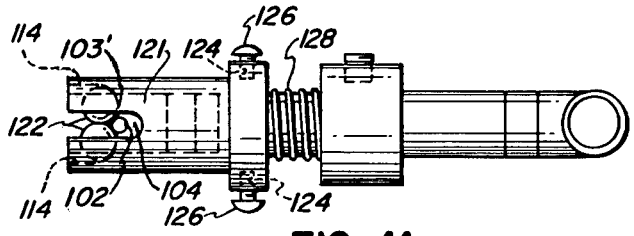
FIG. 11 is a bottom view of the embodiment of FIG. 10.

FIG. 10 shows an embodiment of the instant invention identical in all respects to that shown in FIG. 7 except that the sliding yoke 118 is rectangular in cross-section rather than cylindrical and contains four low friction spheres 122 configured as a pair of mutually impinging spheres as described in FIGS. 7, 8 and 9. This configuration provides for a pair of identical slot 103' vertically displaced. At the neck of the sliding yoke 118 are two shallow tapped cavities 124 with screws 126, seen more clearly in FIG. 11. Spring 128 which limits the rearward motion of the sliding yoke is external rather than internal. In all other respects the embodiment shown in FIGS. 10 and 11 operates in the same manner as the embodiment in FIGS. 7, 8 and 9. In addition, FIGS. 10 and 11 show slot 121 which may be used to accommodate the placement of the rear of an arrow shaft 123 (in phantom) for retaining prior to bowstring release.

Figure 13:
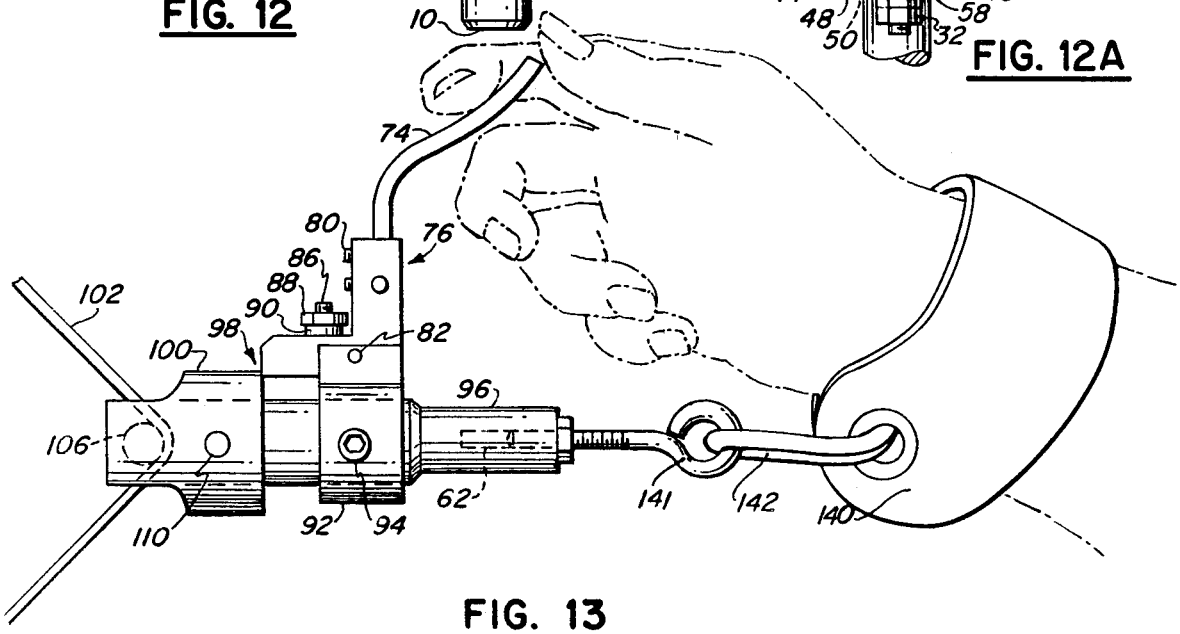

FIG. 13 shows the use of a common sleeve device 140 for attachment to the rear of any of the embodiments of the instant invention by bolt 141 and string 142 for pulling the instant device rearward and holding it there until release.

Smaller or larger devices might be constructed in order to accommodate other uses, such as a quick-release mechanism for a water ski rope.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device adapted to draw back a bowstring on a bow away from a target and toward an archer using said bow to a predetermined position holding said bowstring and releasing said bowstring by finger actuation of the device, comprising:

a rigid shaft having a bifurcated end;

grasping means for manually holding the shaft rotatably connected at one end opposite the bifurcated end of said shaft;

a pair of spherically-shaped bowstring impinging members, each member being located in said bifurcated shaft, the size and shape of said bifurcated shaft selected so that one of said pair of spherically-shaped bowstring impinging members will locate at one horizontal side of said bifurcated shaft and the other of said pair of spherically-shaped bowstring impinging members will locate at the other horizontal side of said bifurcated shaft;

impinging member retaining means movably connected to said shaft, said impinging member retaining means having a first position for forcing said impinging members firmly into contact with each other to restrain a bowstring on the side of said impinging members nearest the archer within said bifurcated end of said shaft and which is movable to a second position allowing said impinging members to separate a sufficient distance to allow a bowstring to pass between said impinging members; and a finger-actuated means operatively connected to said impinging member retaining means said finger-actuated means being pivoted to disengage said impinging means, member retaining as to permit said retaining means to move independently from said first position to said second position.

2. A device for drawing back a bowstring as in claim 1 including:

a biasing means for resiliently holding said retaining means in said first position.

3. A device for drawing back a bowstring as in claim 2, wherein said finger-actuated means is pivotably connected to said shaft.

4. A device for drawing back a bowstring as in claim 3, wherein:

said finger-actuated means includes a housing means for creating a greater distance between said finger-actuated means and said pivotal connection to said impinging member retaining means.

5. A device for drawing back a bowstring as in claim 2, wherein:

said impinging member retaining means is slideably connected to said shaft.

6. A device for drawing back a bowstring as in claim 5, wherein:

said biasing means is contained within said shaft and connected to said impinging member retaining means.

* * * * *